US008556364B2

(12) United States Patent
Hoisington et al.

(10) Patent No.: US 8,556,364 B2
(45) Date of Patent: Oct. 15, 2013

(54) DETERMINING WHETHER A FLOW PATH IS READY FOR EJECTING A DROP

(75) Inventors: Paul A. Hoisington, Hanover, NH (US); Mats G. Ottosson, Saltsjo-Boo (SE); Steven H. Barss, Wilmot Flat, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 474 days.

(21) Appl. No.: 12/829,288

(22) Filed: Jul. 1, 2010

(65) Prior Publication Data

US 2012/0001966 A1 Jan. 5, 2012

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

| | | | | |
|---|---|---|---|---|
| 5,265,315 | A | 11/1993 | Hoisington et al. | |
| 6,554,407 | B1 | 4/2003 | Ikeda et al. | |
| 7,566,118 | B2 | 7/2009 | Bibl et al. | |
| 2002/0135623 | A1* | 9/2002 | Tsukada et al. | 347/7 |
| 2006/0023032 | A1* | 2/2006 | Bibl et al. | 347/68 |
| 2007/0040860 | A1 | 2/2007 | Chou et al. | |
| 2007/0153032 | A1 | 7/2007 | Chou et al. | |
| 2010/0007704 | A1* | 1/2010 | Nitta | 347/68 |
| 2010/0207974 | A1 | 8/2010 | Menzel et al. | |

FOREIGN PATENT DOCUMENTS

| | | |
|---|---|---|
| JP | 10-029321 | 2/1998 |
| KR | 10-2009-0001218 | 1/2009 |
| WO | WO2009142908 A1 | 11/2009 |

OTHER PUBLICATIONS

Authorized Officer S. Kim International Search Report and Written Opinion in International Application No. PCT/US2011/042375, Feb. 9, 2012, 9 pages.
International Preliminary Report on Patentability in International Application No. PCT/US2011/042375, dated Jan. 8, 2013, 6 pages.

* cited by examiner

*Primary Examiner* — Laura Martin
(74) *Attorney, Agent, or Firm* — Fish & Richardson P.C.

(57) ABSTRACT

A method of determining whether a flow path is ready for ejection includes supplying liquid to the flow path, which includes a pumping chamber and a nozzle, after supplying fluid to the flow path, applying energy to an actuator adjacent to the pumping chamber, measuring an electrical characteristic of the actuator to obtain a measured value, and comparing the measured value to a threshold value to determine if the flow path is ready for ejection.

29 Claims, 8 Drawing Sheets

DETERMINING WHETHER A FLOW PATH IS READY FOR EJECTING A DROP

BACKGROUND

This invention relates to fluid ejection devices. In some fluid ejection devices, fluid droplets are ejected from one or more nozzles onto a medium. The nozzles are fluidically connected to a fluid path that includes a fluid pumping chamber. The fluid pumping chamber can be actuated by an actuator, which causes ejection of a fluid droplet. The medium can be moved relative to the fluid ejection device. The ejection of a fluid droplet from a particular nozzle is timed with the movement of the medium to place a fluid droplet at a desired location on the medium. In these fluid ejection devices, it is usually desirable to eject fluid droplets of uniform size and speed and in the same direction in order to provide uniform deposition of fluid droplets on the medium.

SUMMARY

In one aspect, a method of determining whether a flow path is ready for ejection including supplying liquid to the flow path, which includes a pumping chamber and a nozzle, after supplying fluid to the flow path, applying energy to an actuator adjacent to the pumping chamber, measuring an electrical characteristic of the actuator to obtain a measured value, and comparing the measured value to a threshold value to determine if the flow path is ready for ejection.

This and other implementations can optionally include one or more of the following features. The measured value includes an equivalent series resistance, Rs, of the actuator. The flow path is in a print head, and the method includes signaling the print head that the flow path is ready for ejection if the equivalent series resistance is greater than the threshold value. The threshold value is an equivalent series resistance of the actuator for a flow path that is ready for ejection. The equivalent series resistance is measured at a frequency of 100 kHz or greater. The method includes purging fluid from the flow path if the equivalent series resistance is less than the given value. The method also include remeasuring the equivalent series resistance of the actuator after purging, and comparing the remeasured resistance to the given value to determine if the flow path is ready for ejection. The actuator includes piezoelectric material. The measured value includes an equivalent parallel resistance of the actuator, (1/Rp). The flow path is in a print head, and the method includes signaling the print head that the flow path is ready for ejection if the equivalent parallel resistance (1/Rp) is less than the threshold value. The method includes purging fluid from the flow path if the equivalent parallel resistance (1/Rp) is more than the threshold value. The measured value includes a power loss of the actuator. The power loss is measured by determining a current through the actuator and multiplying the current by an applied voltage and calculating a time average of the current multiplied by the applied voltage using an equation, $P_{loss}=1/T\int_0^T(t)V(t)dt$, where $P_{loss}$ is the power loss, I(t) is the current as a function of time, and V(t) is the voltage as a function of time. The flow path is in a print head, and the print head includes a plurality of flow paths, a plurality of actuators, and a current sensing circuit to detect the current through a plurality of actuators. The print head includes a plurality of flow paths, a plurality of actuators, and a plurality of current sensing circuits, wherein each current sensing resistor is coupled to an associated actuator to detect the current through that associated actuator. The measured value includes a dissipation of the actuator. Applying energy to the actuator includes applying a drive pulse to the actuator. The drive pulse is at a lower amplitude than a drive amplitude such that a fluid drop is not ejected through the nozzle. Applying energy to the actuator can include applying a waveform selected from the group consisting of sinusoidal waves, square waves, and trapezoidal waves. The method includes printing on a substrate while measuring the electrical characteristic of the actuator. The method can also include moving the print head to a maintenance station to measure the electrical characteristic of the actuator.

In another aspect, a print system includes a print head having a flow path including a pumping chamber and a nozzle, an actuator adjacent to the pumping chamber, a circuit configured to measure an electrical characteristic of the actuator to obtain a measured value, and a controller configured to compare the measured value to a threshold value to determine if the flow path is ready for ejection.

This and other implementations can optionally include one or more of the following features. A controller is configured to send a signal to the print head to purge fluid from the flow path if the measured value is below the given value. The controller is configured to send a signal to the print head to begin printing if the measured value is greater than the given value. The circuit includes a member selected from the group consisting of a capacitance meter, a multimeter, and an impedance meter. The print system includes a plurality of flow paths and a plurality of actuators, wherein the circuit includes a current sensing circuit for each actuator, a switch for each actuator, and a low pass filter. The print system includes a plurality of flow paths and a plurality of actuators, wherein the circuit includes a current sensing circuit for the plurality of actuators, a switch for each actuator, and a low pass filter. The circuit is positioned on the print head drive circuit board. The print system includes a maintenance station and the circuit is positioned at the maintenance station.

Potential advantages may include may include none, one or more of the following. An electrical characterization of an actuator can be used to determine whether a flow path is ready to eject a drop without having to print a test sample. An electrical characterization can also prevent wasting jetting fluid by purging only when necessary rather than at predetermined intervals. A purging procedure can be performed only when it is actually needed and/or only on the flow paths that need to be serviced. Otherwise, printing can continue uninterrupted if all of the flow paths are ready for ejection. The electrical characterization can also provide feedback about whether the purging procedure was successful. In addition, the measurements of the electrical characteristic of the actuator can be performed using either a circuit positioned on the maintenance station or on the print head drive circuit board. The actuators can be tested either while the print head is printing or idle.

The details of one or more embodiments of the invention are set forth in the accompanying drawings and the description below. Other features, objects, and advantages of the invention will be apparent from the description and drawings, and from the claims.

DETAILED DESCRIPTION

Before performing a printing operation, a fluid ejector needs to be "primed", i.e., filled with the fluid to be ejected. Conventionally, to determine whether the priming procedure was successful, a test sample is printed and examined. However, printing and analyzing test samples can be time consuming and wastes jetting fluid. If the fluid being jetted is expensive, test samples can also be costly. A possible technique to avoid this problem is to characterize the electrical properties of an actuator and use the characteristics to determine whether a flow path is primed. Similarly, the electrical characteristics of the actuator can be used to detect other failures that make the flow path fully or partially inoperable, such as a clogged nozzle or an electrical problem with the actuator. For example, the electrical characteristics could be used to detect any loss of ejection capability, even though the flow path was still able to eject some fluid.

Fluid droplet ejection can be implemented with a substrate, for example a microelectromechanical system (MEMS) fabricated on the substrate. The substrate can include a fluid flow path body, a membrane, and a nozzle layer. The flow path body has a fluid flow path formed therein, which can include some or all of the following features: a fluid fill passage, a fluid pumping chamber, a descender, and a nozzle having an outlet. An actuator can be located on a surface of the membrane opposite the flow path body and proximate to the fluid pumping chamber. When the actuator is actuated, the actuator imparts a pressure pulse to the fluid pumping chamber to cause ejection of a droplet of fluid through the outlet. The flow path body can include multiple fluid flow paths and nozzles, and each fluid flow path can have an associated actuator, so that the substrate includes a plurality of independently actuatable fluid ejectors.

A fluid droplet ejection system can include the substrate with one or more independently actuatable fluid ejectors, a source of fluid for the substrate, and a controller to apply electrical signals to actuate the actuators. The fluid source can be a fluid reservoir fluidically connected to the substrate, e.g., by passages in tubing, chambers in housings, or the like, for supplying fluid for ejection. The fluid is a liquid, and can be, for example, a chemical compound, a biological substance, or ink.

Figure 1A:
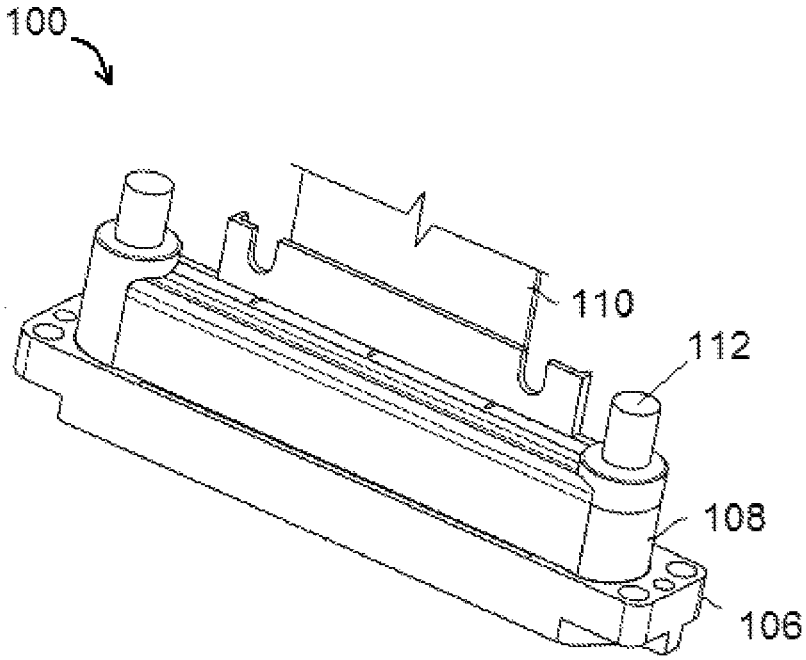
FIG. 1A is a perspective view of a print head module.
Figure 1B:
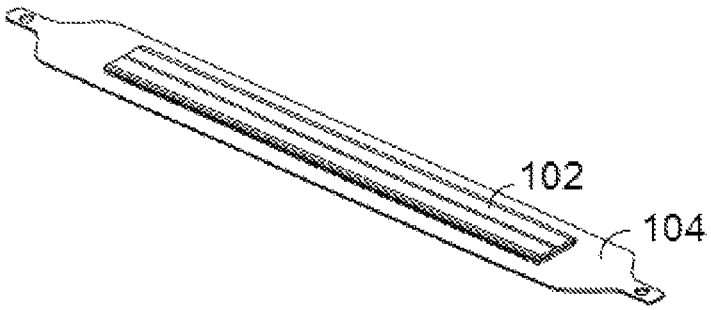
FIG. 1B is a perspective view of a body and face plate of a print head module.

FIGS. 1A and 1B show a print head module 100 including a print head body 102 and face plate 104 attached to a bottom surface of a housing 106, a filter assembly 108 including fluid passages that fluidically connect to the body 102, and a flexible cable 110. The print head body can be, for example, a MEMS silicon die, such as the print head described in Hoisington, et al., U.S. Pat. No. 5,265,315, or the semiconductor print head unit described in Bibl et al., U.S. Pat. No. 7,566,118, the disclosures of which are hereby incorporated by reference. The print head body can be etched to define a plurality of flow paths, each flow path including a pumping chamber and a nozzle to eject fluid drops. The body can also include a plurality of actuators (e.g. piezoelectric or thermal), with one actuator for each flow path. A piezoelectric actuator can include a layer of piezoelectric material that changes geometry: grows, shrinks or bends, in response to an applied voltage. The movement of the piezoelectric layer pressurizes fluid in a pumping chamber along the flow path.

Figure 2:
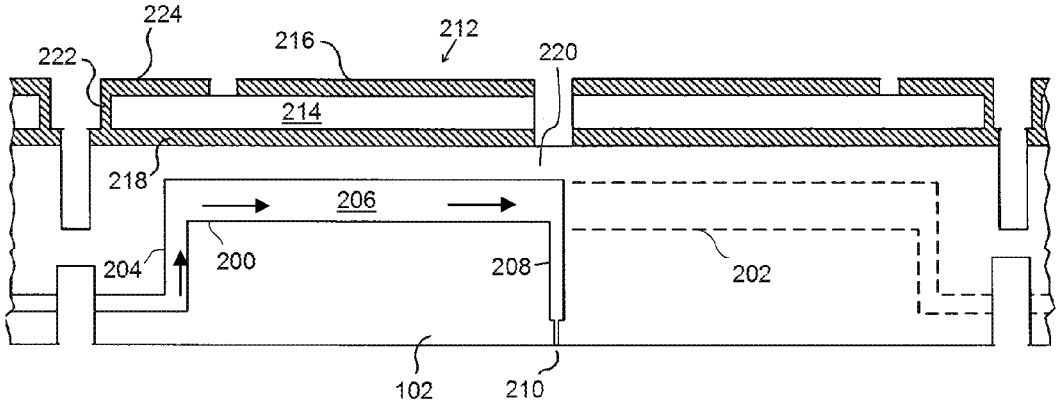
FIG. 2 is a cross-sectional side view of a portion of a print head body showing two flow paths (one shown in phantom) and two actuators.

To prepare for printing, fluid is supplied to the print head module, for example, from a fluid reservoir (not shown) through a fluid inlet 112 in the filter assembly 108. The fluid can travel through the filter assembly 108 and the housing 106 to the print head body 102. The fluid enters a flow path 200 as shown in FIG. 2. FIG. 2 shows a cross-section of the print head body 102 including a cross-section of a flow path 200 and another flow path 202 in phantom. The fluid can fill the flow path, which may include a fluid fill passage 204, a pumping chamber 206, a descender 208, and a nozzle 210. A negative pressure can be applied to the flow path to prevent fluid from leaking out of the nozzle 210 and also to form a meniscus at the nozzle 210.

Filling the flow path with fluid can also be referred to as "priming" the flow path. Fluid is purged through the flow path displacing the air in the flow path, such that the flow path is completely filled with fluid without any air bubbles. A print head can be primed when a print head is first installed in a printer, before the start of a print job, or at periodic intervals during a printing operation. Conventionally, to determine whether the priming procedure was successful, a test sample is printed and examined for unprinted areas corresponding to unprimed flow paths. Printing and analyzing test samples can be time consuming and wastes jetting fluid. If the fluid being jetted is expensive, test samples can also be costly.

During printing, a flow path can become unprimed, blocked, or experience another type of failure that causes the flow path to become fully or partially inoperable. A flow path can become unprimed, for example, if an air bubble is ingested through the nozzle, if an air bubble grows in the flow path due to rectified diffusion, if the ink becomes saturated with air and air bubbles nucleate together and block the flow path (e.g., when heating a water-based ink), or if an air bubble enters the flow path from the fluid reservoir. A flow path can become blocked, for example, if fluid dries in the nozzle, a particle enters the flow path from a fluid supply or from outside the nozzle. However, without printing a test sample, it is not possible to know whether any of the flow paths need to be serviced. Therefore, a purging procedure is usually executed at predetermined intervals to re-prime any flow paths that may have become unprimed or blocked. However, this purging procedure may be executed long before or after purging is actually needed. Even after the purging procedure, there is no way of knowing whether the purging procedure was successful, unless a test sample is printed.

Rather than printing test samples or purging at predetermined intervals, an electrical characteristic of an actuator can be measured, and the measured value of the characteristic can be used to determine whether a flow path is ready for ejection. In that case, a purging procedure is performed only when it is actually needed and only on the flow paths that need to be purged. Further, the measurement of the electrical characteristic can provide feedback about whether the priming procedure was successful without having to print a test sample. If the electrical characteristic shows that all the flow paths are ready for ejection, printing can continue uninterrupted.

For example, the electrical characteristic of the actuator could be the impedance of the actuator. The impedance can be measured across terminals connected to the electrodes of the actuator. To a first approximation, for a piezo-electric actuator the impedance is capacitive in the frequency range used to eject fluid from the flow paths, such as between 0 and 250 kHz. Taking dielectric losses of the material (e.g. piezoelectric) and complex elasticities into account, the impedance of the actuator will consist of a real part that correlates to the losses and an imaginary part that correlates to the elastic and dielectric properties. Adding fluid to a flow path in electromechanical contact with the actuator will add additional viscous losses that will increase the real part of the impedance because of the work done on the fluid by the actuator.

Figure 3:
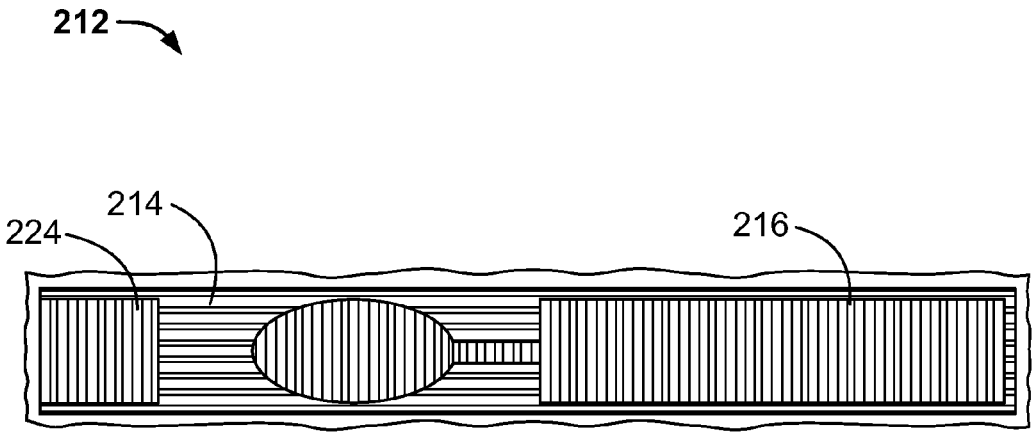
FIG. 3 is a plan view of an implementation of an actuator.

FIG. 2 shows a cross-section of an actuator 212 including a layer 214 of piezoelectric material between a drive electrode 216 and a common electrode 218. In this implementation, the drive electrode 216 is located on a top surface of the piezoelectric layer 214 and the common electrode 218 is located on a bottom surface of the piezoelectric layer between the piezoelectric layer and the membrane 220, but the reverse is possible. The actuator 212 can include a wrap-around 222 that connects a contact pad 224 on a top surface of the piezoelectric layer 214 with the common electrode 218, such that the common electrode can be electrically contacted from the top surface of the piezoelectric layer 214. FIG. 3 shows a top view of a single actuator 212 including the drive electrode 216 and the contact pad 224 for the common electrode on the piezoelectric layer 214. An electrical characteristic of the actuator, e.g., impedance, can be measured, for example, across the drive electrode 216 and common electrode 218 to determine whether a flow path is ready for ejection.

Figure 4:
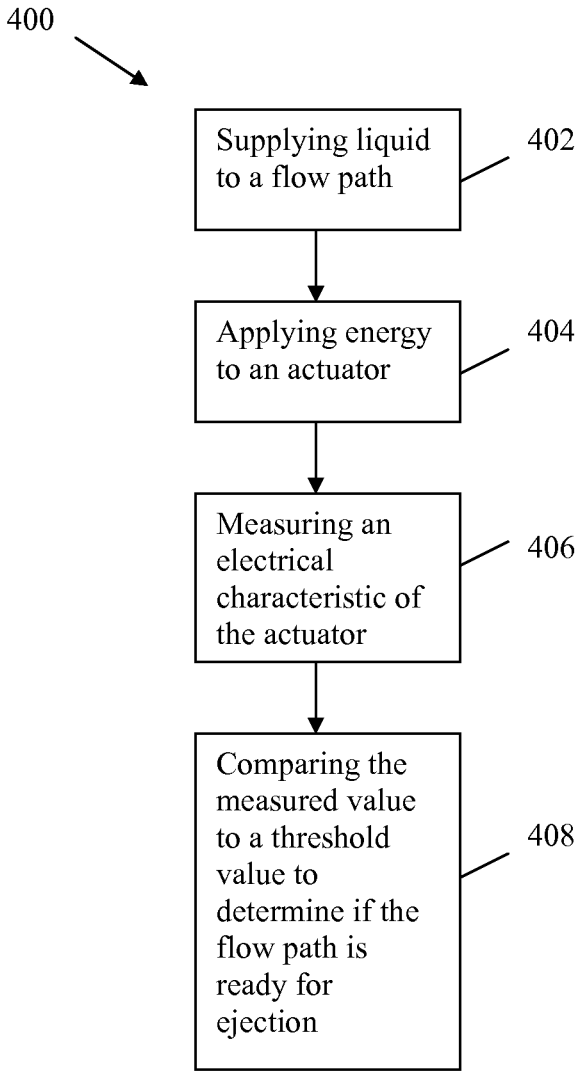
FIG. 4 is a flowchart for a method of determining whether a flow path is ready for ejection.

FIG. 4 shows a flowchart 400 for a method of determining whether a flow path is ready for ejection. First, liquid is supplied to a flow path, e.g. in attempt to prime the flow path (step 402). Second, energy is applied to an actuator adjacent to a pumping chamber in the flow path (step 404). The energy can be in the form of a waveform having a given voltage. The energy of the waveform may be insufficient to cause ejection of a fluid droplet. Third, an electrical characteristic of the actuator is measured, for example, while energy is being applied to the actuator (step 406). The electrical characteristic can be the equivalent series resistance, equivalent parallel resistance, dissipation or power loss of the actuator. Fourth, the measured value of the electrical characteristic is compared to a threshold value to determine if the flow path is ready for ejection (step 408). The threshold value can correlate to a value of an electrical characteristic when the actuator is ready for ejection. The flow path is considered ready for ejection when the measured value is equal to or beyond, e.g., greater than, the threshold value. Alternatively, the threshold value can correlate to a value when the actuator is not ready for ejection and the measured value must be a certain percentage beyond the threshold value for the flow path to be considered ready.

Figure 5A:
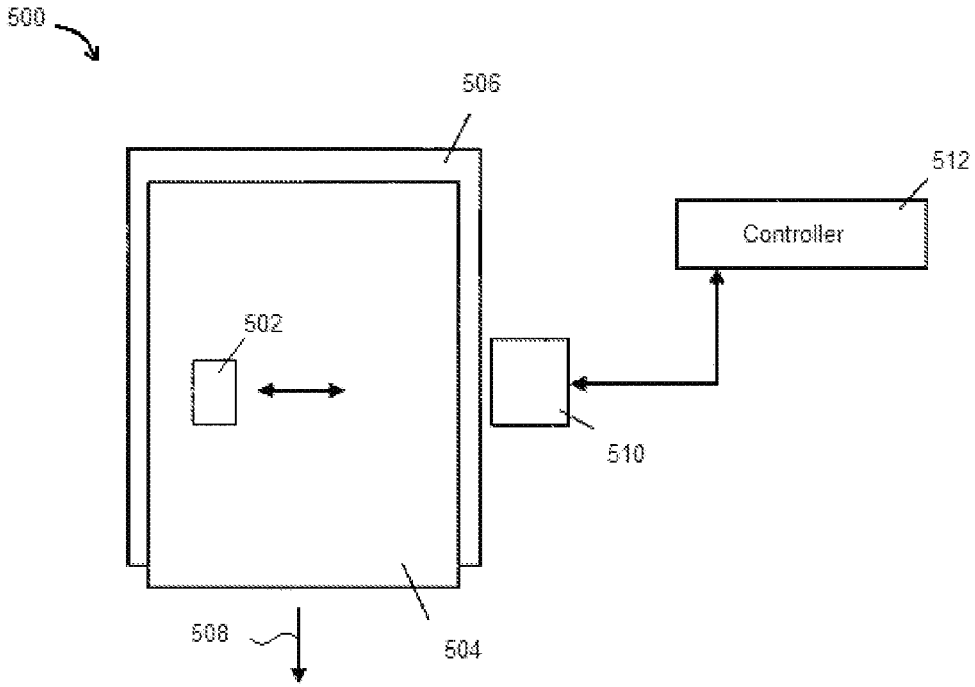
FIG. 5A is a schematic of a print system including a print head printing on a substrate moving on a conveyor, a maintenance station for the print head, and a control unit.
Figure 5B:
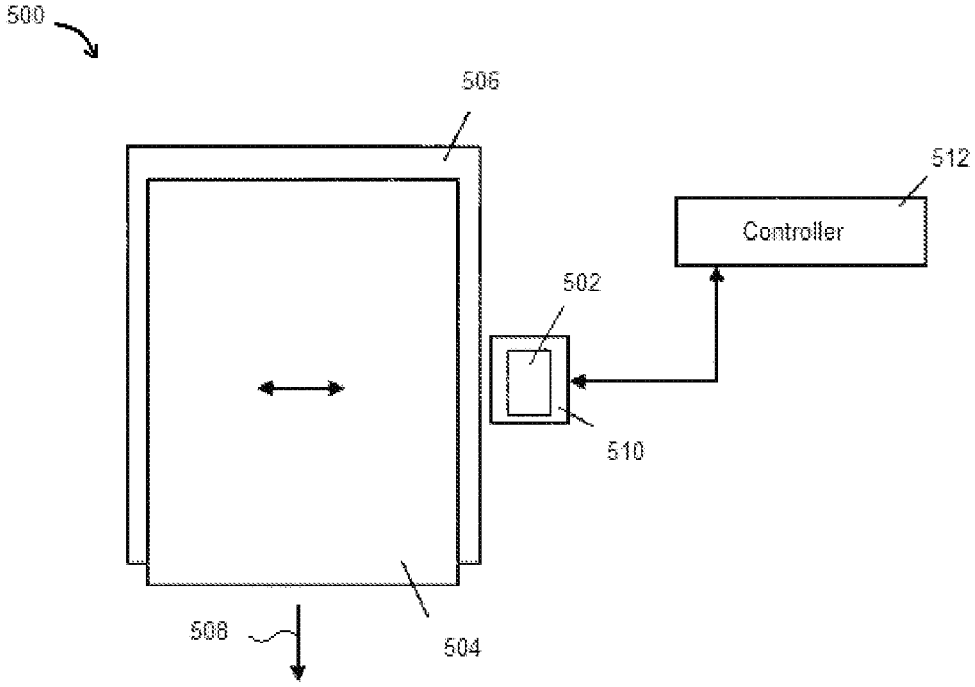
FIG. 5B is a schematic of a print system with the print head at the maintenance station.

FIG. 5A shows a print system 500 including a print head 502 printing on a substrate 504 moving on a conveyor 506 in a process direction 508. The print head 502 can move to a maintenance station 510 for servicing, such as wiping fluid from the nozzle layer. FIG. 5B shows the print system with the print head 502 at the maintenance station 510. At the maintenance station, the print head 502 can be tested to determine whether the flow paths are ready for ejection by measuring an electrical characteristic of each actuator. In some implementations, the maintenance station 510 can include a capacitance meter, multimeter, or impedance meter, such as the Fluke PM6304, that can apply a sinusoidal voltage to the electrodes on the actuator and measure the amplitude and phase of the current through the actuator. The voltage and frequency of the applied signal are adjustable. The voltage amplitude can be smaller than the drive pulse used to eject a drop from the nozzle. The frequency can be between 100 Hz and 1 MHz, e.g., 100 Hz, 1 kHz, 10 kHz, 100 kHz, or 1 MHz. The impedance meter calculates the current amplitude that is in phase with the driving voltage (corresponding to a loss element) and the current amplitude that is 90 degrees phase shifted relative to the input voltage (corresponding to an energy conserving element). Using the two measurements (voltage and current), two impedances can be solved, such as the equivalent series resistance Rs and capacitance C. Alternatively, the impedance meter can calculate the equivalent parallel resistance Rp and C, or dissipation D and C. A piezoelectric actuator can dissipate about 5% of the applied energy and this is usually the dominant loss in the system.

The measured value (Rs, Rp, D) can be sent to the controller 512 and compared to a threshold value to determine whether the flow path is ready for ejection. If the measured value does not meet the threshold value, the flow path is determined not to be ready for ejection. At the maintenance station, fluid can be purged out of the nozzle in attempt to revive the failed flow path. After purging, the electrical characteristic can be remeasured. The remeasured value is compared to the threshold value. The steps can be repeated until the measured value meets the threshold value. For example, where the measured characteristic is the series resistance or dissipation, the measured characteristic meets the threshold value if it is equal to or greater than the threshold value.

In some implementations, one flow path is tested at a time and once all of the flow paths are determined to be ready for ejection, the controller 512 sends a signal to the print head 502 that the print head is ready for printing.

In other implementations, the flow paths can be divided into groups and a group of flow paths can be tested together, especially if the print head includes a large number of flow paths (e.g. 300 or more, 600 or more, 1000 or more). In this case, the group of flow paths is measured together and an average value of the electrical characteristic is calculated. Likewise, the threshold value is an average value for the given number of flow paths, and this average threshold value is compared to the average measured value to determine if the group of flow paths is ready for ejection. If the average measured value is does not meet the average threshold value, then the group of flow paths can be purged together and retested together. After the group is determined to be ready, the next group is tested, and once all of the groups are determined to be ready, printing can resume.

Figure 6A:
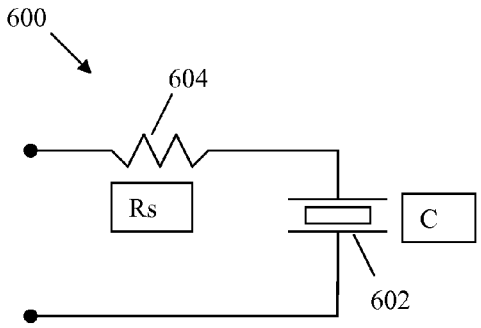
FIG. 6A is a circuit model of an actuator including an equivalent series resistor.

FIG. 6A shows a circuit model 600 of an actuator (e.g. piezoelectric) including a capacitor, C, 602 and an equivalent series resistor, Rs, 604. Rs should be measured at a high frequency (e.g. 100 kHz or greater) because the capacitor C will begin to act like a short and the measured value will mainly comprise Rs. If the measured value of Rs is greater than or equal to the threshold value, the controller sends a signal to the print head that the print head is ready for ejection.

Figure 6B:
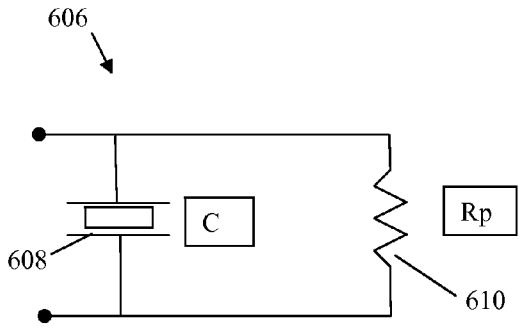
FIG. 6B is a circuit model of an actuator including an equivalent parallel resistor.

FIG. 6B shows a circuit model 606 of an actuator including a capacitor, C, 608 and equivalent parallel resistance, Rp, 610. The equivalent parallel resistance Rp should be measured at a low frequency (e.g. less than 100 kHz) because the capacitor will begin to act like an open and the measured value will mainly comprise (1/Rp). If the measured value of (1/Rp) is less than or equal to a threshold value, the flow path is ready for ejection.

Figure 7:
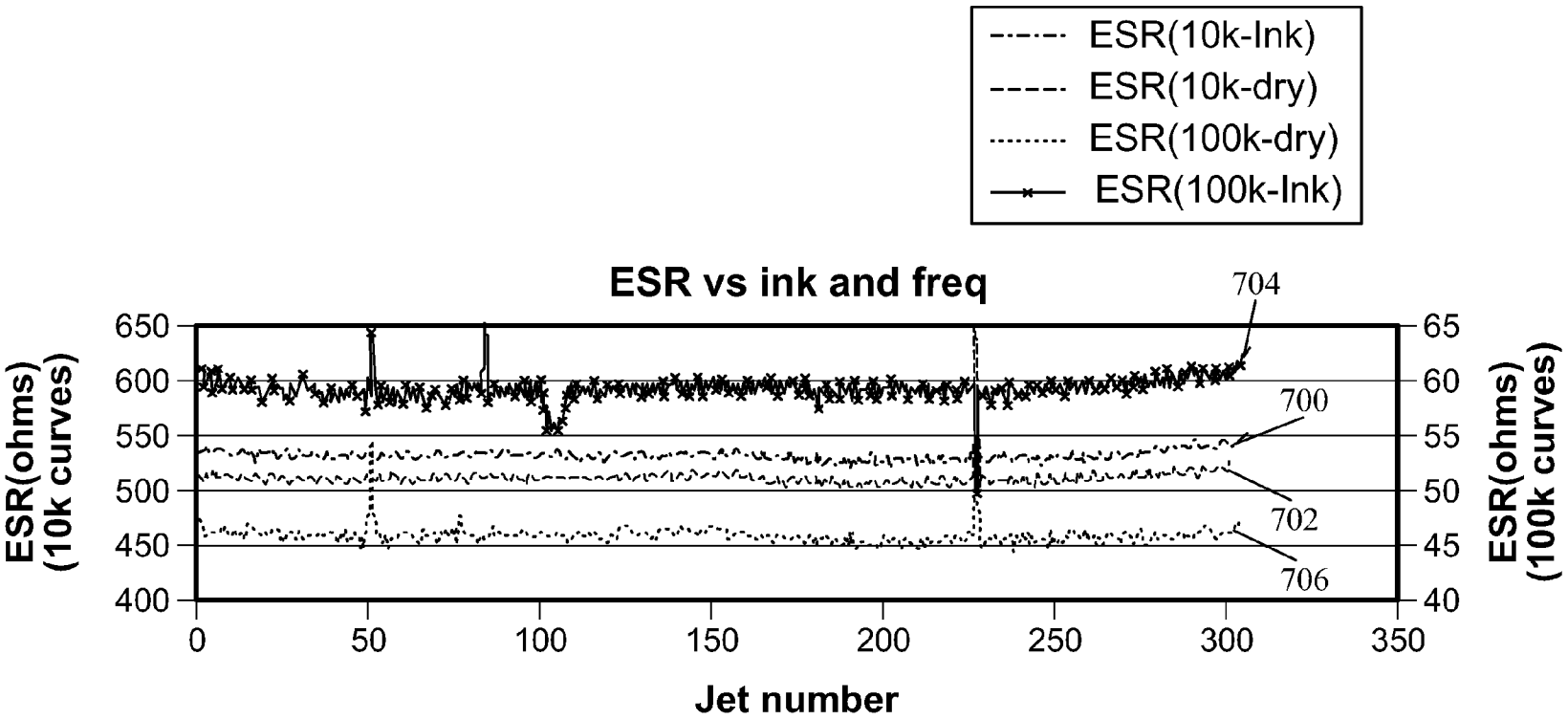
FIG. 7 is a graph showing equivalent series resistance (ESR) measurements of an actuator at a frequency of 10 kHz and 100 kHz with and without fluid in a plurality of flow paths.

To determine a threshold value for a particular print head, the print head could be tested with and without fluid at various frequencies to find a correlation between the electrical characteristic of flow paths ready for printing and flow paths not ready for printing. For example, the flow paths with fluid represent primed flow paths while the paths without fluid represent unprimed flow paths. The graph in FIG. 7 shows equivalent series resistance (ESR) measurements for a plurality of actuators at frequencies of 10 kHz and 100 kHz with and without fluid in a plurality of flow paths. The x-axis represents the jet number corresponding to the flow path number, i.e. 303 flow paths in this print head. The left y-axis represents the ESR values in ohms measured at a frequency of 10 kHz while the right y-axis represents the ESR values in ohms measured at a frequency of 100 kHz. Lines 700 and 702 correlate with the left y-axis while lines 704 and 706 correlate with the right y-axis. Referring to line 706, the average ESR value measured at 100 kHz without fluid (unprimed) is about 45.9 ohms, while for line 704, the average ESR value with fluid (primed) is about 59.2 ohms. According to these measurements, the ESR value increased by about 30 percent when fluid was added to the flow path. Thus, in this print head, a flow path can be determined to be primed if the ESR value is around 59 ohms and unprimed if the ESR value is around 46 ohms. However, line 704 shows a dip around flow paths 100 to 110 with ESR values around 55-57 ohms. This could mean that these flow paths are partially but not completely primed. Therefore, for this print head, an ESR value of about 58 ohms could be chosen as the threshold value in determining whether a flow path is ready for ejection.

Rather than using a maintenance station to determine whether the flow paths are ready for printing, the flow paths can be tested in-situ. For example, the electrical characteristic of the actuators can be measured using a circuit positioned on the print head drive circuit board instead of on an external maintenance station. The print head drive circuit board can include application-specific integrated circuit (ASIC) switches that can be used to measure the electrical characteristics of the actuators. In some implementations, the electrical characteristic can be measured while the print head is printing on a substrate. If the flow paths in the print head are determined to be ready for ejection, printing can continue without interruption. If a flow path is determined not to be fully or partially inoperable, the print head can move to a maintenance station to purge fluid until the flow path is ready for printing. In addition, unlike an impedance meter that is generally limited to a sinusoidal wave, a circuit can be built that can measure the electrical characteristic using any waveform shape including sinusoidal wave, square wave, trapezoidal wave, or the drive waveform. For example, the electrical characteristic can be the power loss in the actuator. The loss can be determined using the following equation:

$$P_{loss} = \frac{1}{T}\int_0^T I(t)\cdot V(t)\,dt$$

where $P_{loss}$ is the power loss in the actuator, T is the total time that measurements are taken, I(t) is the current as a function of time, and V(t) is voltage as a function of time. The circuit can be built to sense the current I(t) through an actuator, to multiply the sensed current by an applied voltage V(t), and to take a time average using, for example, a low pass filter. The output can be monitored by a controller. If the loss falls below a threshold value, a signal can be sent to the print head that a flow path is not ready for ejection and the print head can move to the maintenance station to purge the flow path.

Figure 8:
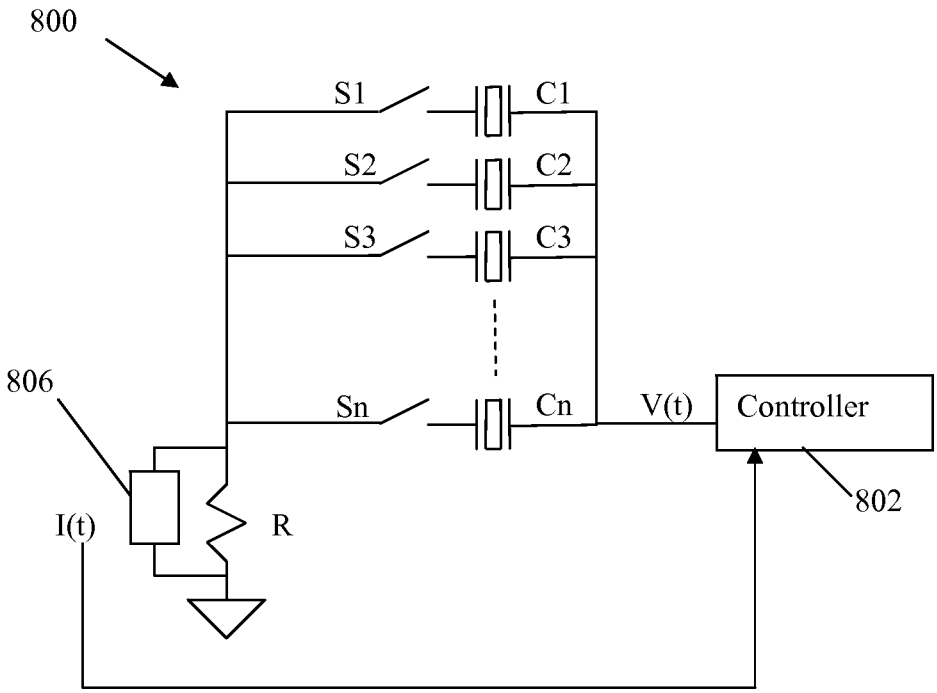
FIG. 8 is a schematic of a circuit used to detect whether a plurality of flow paths is ready for ejection one at a time.

FIG. 8 shows an example of a circuit 800 used in detecting the power loss. The circuit can include a current sensing circuit 806 to sense current passing through a sense resistor R, and a plurality of capacitors C1, C2, C3, . . . Cn. The capacitors can represent the individual actuators that correspond to the individual flow paths, and are connected in parallel to a controller 802 that can apply a voltage waveform. Each capacitor is connected in series with a switch S1, S2, S3, . . . Sn, and the outputs of the switches are connected in parallel to ground through the sense resistor R. This circuit is designed to test the flow paths one at a time. Therefore, the print head can not continue to print while the print head is being tested. To test, each switch S1, S2, S3, . . . Sn is closed one at a time and the current sensing circuit 806 detects the current passing through the sense resistor R for each associated actuator C1, C2, C3, . . . Cn, one at a time. Any waveform can be applied, such as the drive waveform or the drive waveform at a lower amplitude than the drive amplitude so that a drop is not ejected from the nozzle.

For example, the switch S1 is closed and a waveform having a voltage V(t) is applied to C1 and the current sensing resistor R senses a current I(t), which is sent to the controller. The controller multiplies the current I(t) by the applied voltage V(t) and takes a time average to calculate the power loss $P_{loss}$. The controller can compare the value of $P_{loss}$ with a threshold value. For example, if the value of $P_{loss}$ is below the threshold value, then the flow path is determined not to be ready for printing and the flow path is purged until the value of $P_{loss}$ is equal to or greater than the threshold value.

Rather than stopping the print head to test each flow path one at a time, each actuator C1, C2, C3, . . . Cn can have a corresponding current sensing circuit with a current sensing resistor R1, R2, R3, . . . Rn, as shown in the circuit 900 of FIG. 9, so that each flow path can be individually tested while the print head is printing. In this case, switches S1, S2, S3, . . . Sn can be closed at any time to test whether the flow path is operating properly. For example, a switch is closed at the same time that a drive pulse is applied to the actuator and the electrical characteristic is measured using the drive pulse. There is no need for a separate pulse for measuring the electrical characteristic of the actuator. Rather, the electrical characteristic can be measured at the same time that a drive pulse is applied to the actuator for ejecting a drop. This is more efficient because it uses the same pulse and saves time because a separate test pulse is not needed.

Figure 9:
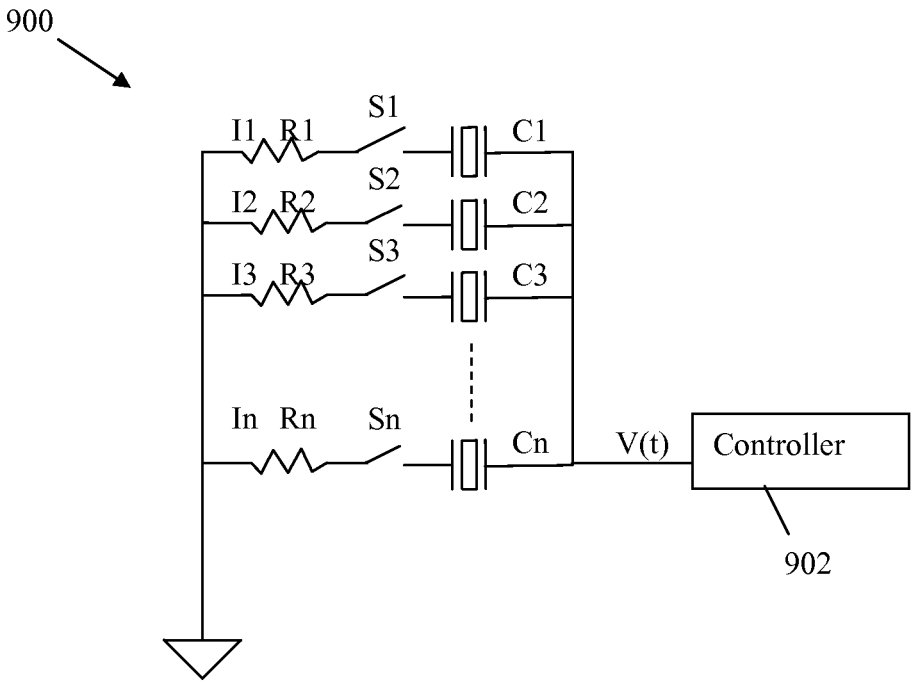
FIG. 9 is a schematic of a circuit used to detect whether a plurality of flow paths is ready for ejection while the print head is printing.

Referring to FIG. 9, switch S1 can be closed, a priming pulse can be applied to actuator C1, and the current I1 is sensed through the current sensing resistor R1. A priming pulse can have a smaller amplitude and/or pulse period than the drive pulse so that the flow path can be tested without ejecting a fluid drop from the nozzle. As described above, the current I1 is multiplied by the voltage V(t) of the priming pulse to calculate the power loss $P_{loss}$ of actuator C1. The controller 902 compares the $P_{loss}$ to a threshold value to determine whether the flow path is ready for ejection. If the flow path is ready, the print head can continue printing without interruption. However, if the flow path is not ready, the print head can be moved to a maintenance station to purge the failed flow path. Alternatively, to avoid interrupting the print job, the print data sent to the print head could be reconfigured such that neighboring flow paths compensate for the failed flow path. Compensating for failed flow paths can also delay performing a maintenance operation, which can save ink wasted by purging, improve throughput since purging is time consuming, and reduce wear and tear on the print head caused by maintenance operations.

The use of terminology such as "top" and "bottom" throughout specification and claims is for illustrative purposes only and does not imply a particular orientation of the assembly.

A number of embodiments of the invention have been described. Nevertheless, it will be understood that various modifications may be made without departing from the spirit and scope of the invention. Accordingly, other embodiments are within the scope of the following claims.

What is claimed is:

1. A method of determining whether a flow path is ready for ejection, comprising:

supplying fluid to the flow path, which includes a pumping chamber and a nozzle;

after supplying the fluid to the flow path, applying energy to an actuator adjacent to the pumping chamber;

measuring an electrical characteristic of the actuator to obtain a measured value; and comparing the measured value to a threshold value to determine if the flow path is ready for ejection; and purging the fluid from the flow path if the flow path is not ready for ejection.

2. The method of claim 1, wherein the measured value comprises an equivalent series resistance, Rs, of the actuator, and the flow path is not ready for ejection when the equivalent series resistance is less than the threshold value.

3. The method of claim 2, wherein the flow path is in a print head, the method further comprising signaling the print head that the flow path is ready for ejection if the equivalent series resistance is greater than the threshold value.

4. The method of claim 2, wherein the equivalent series resistance is measured at a frequency of 100 kHz or greater.

5. The method of claim 2, further comprising remeasuring the equivalent series resistance of the actuator after purging, and comparing the remeasured resistance to the threshold value to determine if the flow path is ready for ejection.

6. The method of claim 1, wherein the actuator comprises a piezoelectric material.

7. The method of claim 1, wherein the measured value comprises an equivalent parallel resistance of the actuator, (1/Rp), and the flow path is not ready for ejection when the equivalent parallel resistance is greater than the threshold value.

8. The method of claim 7, wherein the flow path is in a print head, the method further comprising signaling the print head that the flow path is ready for ejection if the equivalent parallel resistance (1/Rp) is less than the threshold value.

9. The method of claim 1, wherein the measured value comprises a power loss of the actuator.

10. The method of claim 9, wherein the power loss is measured by determining a current through the actuator and multiplying the current by an applied voltage and calculating a time average of the current multiplied by the applied voltage using an equation, $P_{loss}=1/T\int_0^T I(t)V(t)dt$, where $P_{loss}$ is the power loss, I(t) is the current as a function of time, and V(t) is the applied voltage as a function of time.

11. The method of claim 10, wherein the flow path is in a print head, the print head further comprises a plurality of flow paths, a plurality of actuators, and a current sensing circuit to detect the current through a plurality of actuators.

12. The method of claim 10, wherein the flow path is in a print head, the print head further comprises a plurality of flow paths, a plurality of actuators, and a plurality of current sensing circuits, wherein each current sensing resistor is coupled to an associated actuator to detect the current through that associated actuator.

13. The method of claim 1, wherein the measured value comprises a dissipation of the actuator.

14. The method of claim 1, wherein applying energy to the actuator comprises applying a drive pulse to the actuator.

15. The method of claim 14, wherein applying energy to the actuator comprises applying the drive pulse at a lower amplitude than a drive amplitude such that a fluid drop is not ejected through the nozzle.

16. The method of claim 1, wherein applying energy to the actuator comprises applying a waveform selected from the group consisting of sinusoidal waves, square waves, and trapezoidal waves.

17. The method of claim 1, further comprising printing on a substrate while measuring the electrical characteristic of the actuator.

18. The method of claim 1, wherein the flow path is in a print head, further comprising moving the print head to a maintenance station to measure the electrical characteristic of the actuator.

19. The method of claim 1, wherein the actuator adjacent to the pumping chamber is configured to eject fluid from the pumping chamber through the nozzle.

20. A print system, comprising:

a print head having a flow path including a pumping chamber and a nozzle;

an actuator adjacent to the pumping chamber;

a circuit configured to measure an electrical characteristic of the actuator to obtain a measured value; and a controller configured to compare the measured value to a threshold value to determine if the flow path is ready for ejection, and to send a signal to the print head to purge the flow path if the flow path is not ready for ejection.

21. The print system of claim 20, wherein the controller is further configured to send a signal to the print head to begin printing if the flow path is ready for ejection.

22. The print system of claim 20, wherein the circuit comprises a member selected from the group consisting of a capacitance meter, a multimeter, and an impedance meter.

23. The print system of claim 20, further comprising a plurality of flow paths and a plurality of actuators, wherein the circuit comprises a current sensing circuit for each actuator, a switch for each actuator, and a low pass filter.

24. The print system of claim 20, further comprising a plurality of flow paths and a plurality of actuators, wherein the circuit comprises a current sensing circuit for the plurality of actuators, a switch for each actuator, and a low pass filter.

25. The print system of claim 20, wherein the circuit is positioned on a print head drive circuit board.

26. The print system of claim 20, further comprising a maintenance station, wherein the circuit is positioned at the maintenance station.

27. The print system of claim 20, wherein the actuator adjacent to the pumping chamber is configured to eject fluid from the pumping chamber through the nozzle.

28. A print system, comprising:

a print head having a flow path including a pumping chamber and a nozzle;

an actuator adjacent to the pumping chamber;

a circuit configured to measure an electrical characteristic of the actuator to obtain a measured value; and a controller configured to compare the measured value to a threshold value to determine if the flow path is ready for ejection, and to send a signal to the print head to prime the flow path if the flow path is not ready for ejection.

29. The print system of claim 28, wherein the measured value comprises an equivalent series resistance, Rs, of the actuator, and the flow path is not ready for ejection when the equivalent series resistance is less than the threshold value.

* * * * *